United States Patent [19]

Leliaert

[11] Patent Number: 4,473,972

[45] Date of Patent: Oct. 2, 1984

[54] BLADE FOR CENTRIFUGAL BLASTING WHEELS

[75] Inventor: Raymond M. Leliaert, South Bend, Ind.

[73] Assignee: Wheelabrator-Frye Inc., Hampton, N.H.

[21] Appl. No.: 397,357

[22] Filed: Jul. 12, 1982

[51] Int. Cl.[3] ..... B24C 5/06

[52] U.S. Cl. ..... 51/435; 51/434

[58] Field of Search ..... 51/435, 434, 431, 432, 51/410; 241/275; 416/214 R, 214 A

[56] References Cited

U.S. PATENT DOCUMENTS

| | | | |
|---|---|---|---|
| 2,493,215 | 1/1950 | Barnes | 51/435 |
| 3,151,417 | 10/1964 | Hartman et al. | 51/435 |
| 3,197,920 | 8/1965 | Moore | 51/435 |
| 3,683,556 | 8/1972 | Leliaert | 51/435 X |
| 4,069,025 | 1/1978 | MacMillan | 51/434 |
| 4,333,278 | 6/1982 | Schulte et al. | 51/435 |

*Primary Examiner*—Frederick R. Schmidt

*Assistant Examiner*—Robert A. Rose

*Attorney, Agent, or Firm*—McDougall, Hersh & Scott

[57] ABSTRACT

A blade for use in two different forms of centrifugal blasting wheels. The blade comprises a body generally in the form of a parallelepiped having an inner and an outer end and side flanges to define a blade which is I-shaped in transverse cross-section. The blade includes a first pair of laterally extending retaining lug formations which are adapted to engage the inner annular surfaces of the wheel plates of a first wheel thereby to retain the blade in place. Each of said first lug formations is arcuate and formed at a common radius with a pair of second retaining lug formations which extend from the side flanges of the blade in directions generally at a right angle to the direction the first lug formations extend from such side flanges. When the blade is used in a second wheel, the second lug formations engage abutment surfaces formed in recesses in the wheel plates thereby to retain the blade in place in the second form of blasting wheel.

5 Claims, 8 Drawing Figures 10
10'
30
30'
31
31'
32
32'
34
35
37
38
38a
38b
38'
38a'
38b'
40
41
41'
42
43
45
46
47
48
50
50a
50b
50c
6
8

BLADE FOR CENTRIFUGAL BLASTING WHEELS

Figure 1:
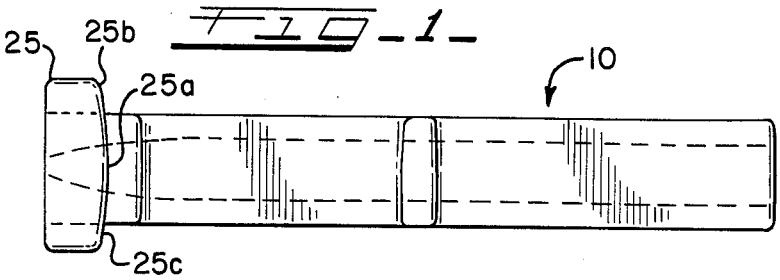

The present invention relates to blades for centrifugal blasting wheels of the type adapted to throw particulate material by centrifugal force from the outer ends of the blades onto an object or surface to be abraded, cleaned, or otherwise engaged by the particulate material for surface treatment. In particular, the present invention relates to a new and improved blade adapted to be used in two or more different types of such blasting wheels.

One form of airless centrifugal blasting wheels of the type described is marketed by Wheelabrator-Frye Inc. under the trademark WHEELABRATOR. Such wheel consists of a pair of spaced parallel annular plates having a number of blades extending radially between the plates in equally circumferentially spaced relationship. The blades are removably secured in place so that they may be readily changed for replacement purposes due to wear.

Means are provided for rotating the wheel at high speed about a central axis and for dispersing particulate material onto the inner end portions of the blades whereby the particulate material is dispersed by centrifugal force outwardly over the surface of the blades and projected at high velocity from the ends of the blades. An impeller is provided in the central opening formed by the annular blades for feeding the particulate material onto the inner ends of the blades. A stationary control gage surrounds the impeller for controlling the passage of particulate material to the blades thereby controlling the direction as well as the blast pattern of the particulate material thrown from the ends of the blades.

The annular side plates of the wheel just described are provided with respective crosswise aligned grooves in their inner faces extending radially in equally circumferentially spaced relation from the inner annular surfaces of the plates to the outer surfaces thereof. Each blade is generally in the form of a parallelepiped having inner and outer ends and side flanges to define a blade which is I-shaped in transverse cross-section. The blade is provided with a pair of operatively disposed retaining lugs adjacent its inner end. These retaining lugs engage the inner annular surfaces of the wheel plates thereby to retain the blade in place with its side flanges received within the radially extending grooves in the inner surfaces of the side plates. This construction also permits ready removal of the blades for replacement purposes. A wheel with blades of the type just described is disclosed in the application of Harold F. Schulte et al., Ser. No. 70,478, filed Sept. 24, 1979, now U.S. Pat. No. 4,333,278, and assigned to the assignee of the present application.

There are other forms of centrifugal blasting wheels being marketed which are generally the same as the wheel just described. However, these wheels differ in the configuration of the various surfaces on the blade and the wheel plates which interengage to retain the blade in place.

In the form of wheel now under consideration, the wheel plates are also provided with respective crosswise arranged recesses which open into the inner annular surfaces of the wheel plates thereby interrupting such surfaces. Each pair of radially extending grooves communicates with a respective pair of said recesses and with the outer annular surfaces of the wheel plates. Each of such recesses extends circumferentially of the wheel plate beyond the adjacent walls which are in parallel spaced relation and which define, at least in part, the radially extending grooves. These recesses thus define pairs of abutment surfaces spaced from the inner annular surfaces of the wheel plates. Each blade is provided with lug formations which engage these abutment surfaces thereby to retain the blade in place during operation of the wheel and which permit removal of the blade for replacement purposes by movement of the blade radially inwardly of the wheel.

It is a principal object of the present invention to provide a blade which is configured for use in either of the two types of wheels described above.

It is another object of the present invention to provide a blade for use in two different forms of blasting wheels, which blade has a first pair of retaining lug formations arranged to engage the inner annular surfaces of the wheel plates of a first wheel thereby to hold the blade in place, and which blade has two additional pairs of retaining lug formations adapted to engage abutment surfaces formed in recesses in the side plates of a second wheel thereby to retain the blade in place in such second wheel.

Figure 2:
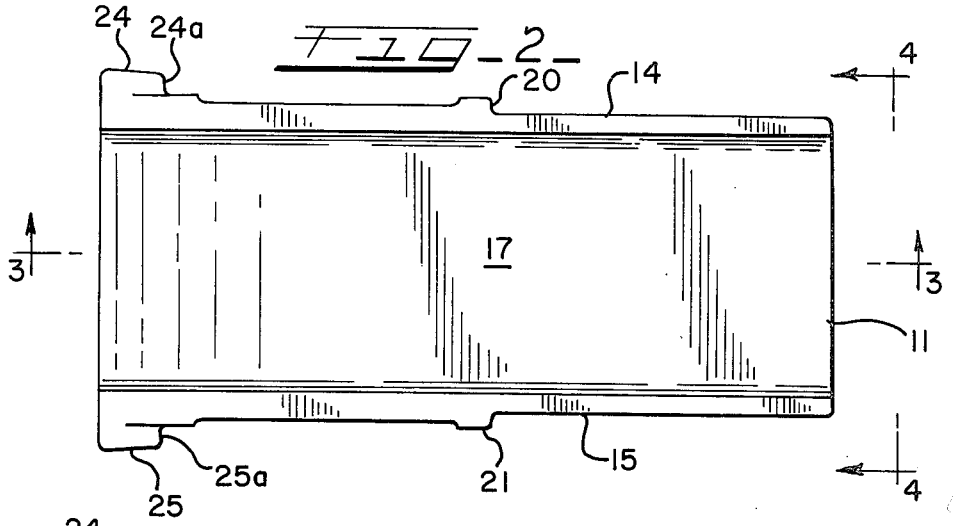
Figure 3:
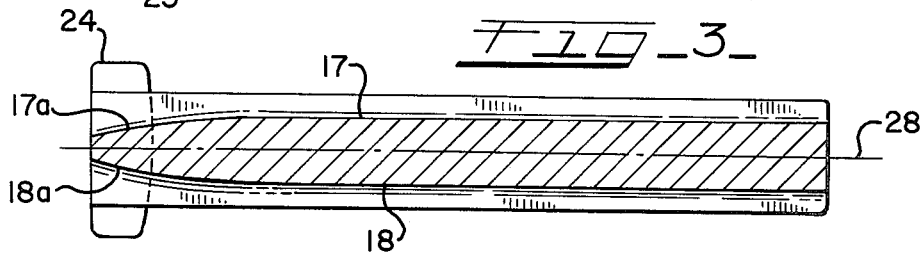
Figure 4:
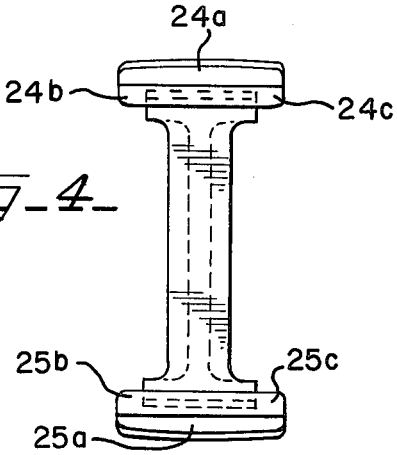
Figures 5, 6, 7, 8:
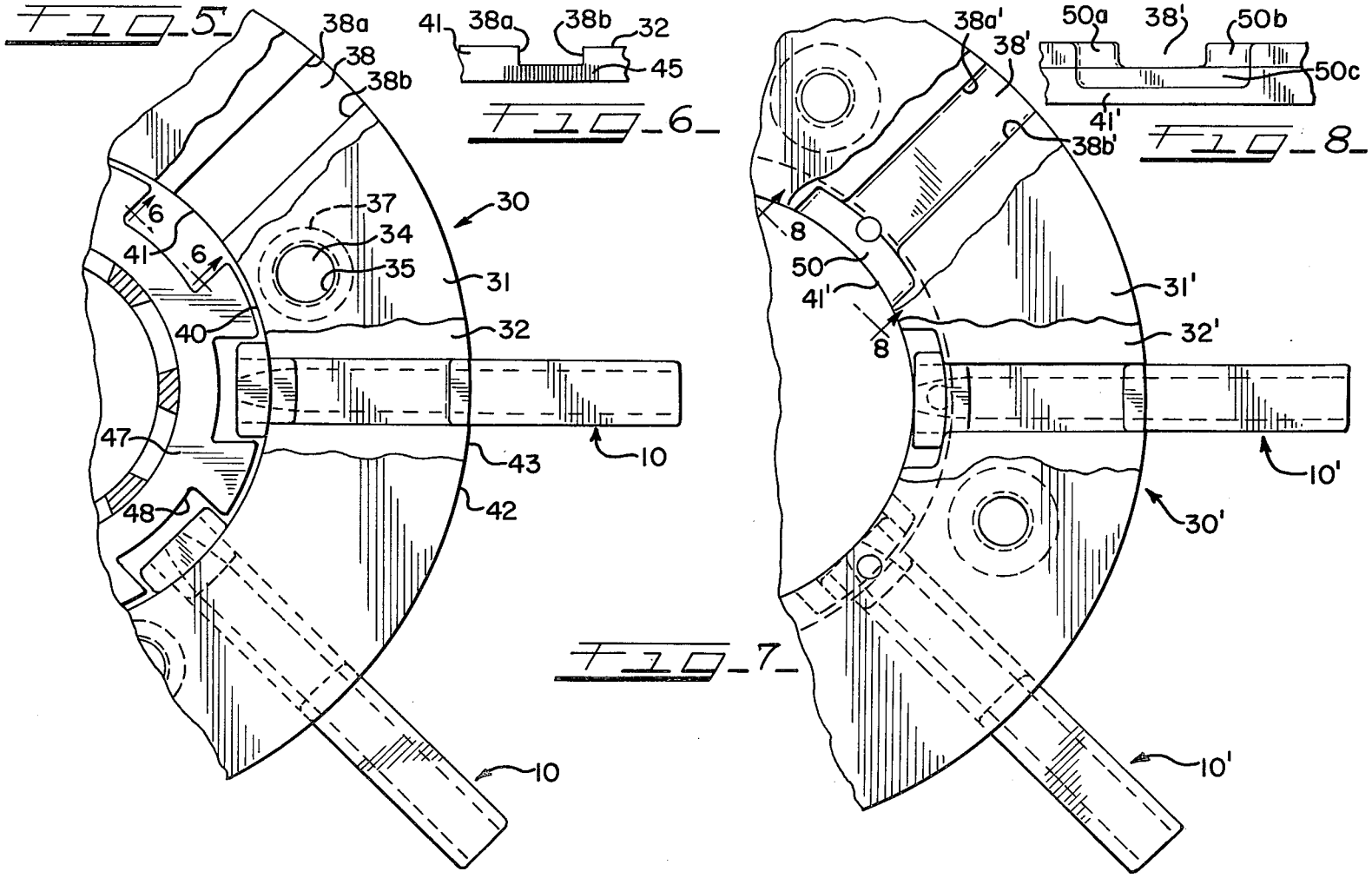

Still another object of the present invention is the provision of a blade of the type just described wherein all of said retaining lug formations are arcuate in shape having a common radius. These and other objectives and advantages of this invention will hereinafter appear and for purposes of illustration, but not of limitation, an embodiment of the invention is shown in the attached drawings wherein:

1. FIG. 1 is a side elevational view of a blade embodying the present invention;
2. FIG. 2 is a plan view of the blade;
3. FIG. 3 is a section taken along the line 3—3 of FIG. 2;
4. FIG. 4 is an end view of the blade as seen along the line 4—4 of FIG. 2;
5. FIG. 5 is a fragmentary side elevational view of a first wheel showing the blades mounted in place, with certain parts being broken away for purposes of better illustration;
6. FIG. 6 is a section taken along the line 6—6 of FIG. 5;
7. FIG. 7 is a fragmentary side elevational view of a second form of wheel showing the blades mounted in place, with certain parts being broken away for purposes of better illustration; and
8. FIG. 8 is a section taken along the line 8—8 of FIG. 7.

Referring particularly to FIGS. 1 through 4, the blade of the present invention, generally designated 10, includes a web portion 11 and side flanges 14 and 15. As noted, the body of the blade is generally in the form of a parallelepiped with the side flanges and web defining an I-shaped transverse cross-section.

The web 11 of the blade is formed with faces 17 and 18. These faces are substantially planer with the inner end portions thereof being slightly curved as at 17*a* and 18*a*, for receipt of particulate blasting material with a minimum of abrasive wear. At this juncture, it should be pointed out that the inner end of the blade is shown to the left in FIGS. 1 through 3.

The side flanges 14 and 15 of the blade are received within radially extending grooves in the side plates of the blade as will be explained in detail below. The side flanges include ears 20 and 21 which may be received within the grooves just mentioned to aid in positioning of the blade.

The blade is provided with a pair of retaining lugs 24 and 25 which extend from respective side flanges 14 and 15. The lugs extend laterally from the side flanges and define a first pair of retaining lug formations 24*a* and 25*a*. As noted in FIGS. 1 and 3, the lugs are thicker than the side flanges of the blade. As best seen in FIG. 4, the lug 24 is configured such that it includes a pair of retaining lug formations 24*b* and 24*c*. In like manner, the retaining lug formation 25*a* joins with a pair of retaining lug formations 25*b* and 25*c*.

The lug formations 24*b*, 24*c*, 25*b* and 25*c* may be characterized as extending from the blade body in directions which are generally at a right angle to the direction the lug formations 24*a*, 25*a* extend from the blade. As noted in FIGS. 1 and 2, all of the various retaining lug formations have an arcuate shape and are formed with a common radius. Thus, the lug formation 24*a*, for example, joins with the lug formations 24*b* and 24*c* in a smooth and continuous manner.

At this juncture, it should be made clear that the blade is symmetrical with the plane 28 indicated in FIG. 3. As will become clear from the description of the wheel to follow, the plane 28 contains the axis of rotation of the wheel when the blade is operatively mounted in place. Of course, the blade is also symmetrical with respect to a plane perpendicular to the plane just mentioned and containing the longitudinal central axis of the blade.

Referring now to FIG. 5, a centrifugal blasting wheel of the type marketed under the trademark WHEELABRATOR is generally designated 30. This wheel includes a pair of front and back annular wheel plates 31 and 32 respectively. These plates are secured to each other in parallel spaced relationship by circumferentially disposed spacers 34 which extend through laterally aligned openings 35 in the wheel plates. The portion of each spacer extending between the plates is protected by a sleeve 37 formed of hard wearresistant material and dimensioned to have a length corresponding to the space between the wheel plates.

The front and back wheel plates 31 and 32 are formed with a crosswise aligned pairs of radially extending grooves 38 spaced circumferentially along the inner surfaces of the wheel plates for receipt of the blades 10. As noted in FIG. 6, each groove 38 of the plate 32 is formed in part by parallel opposed walls 38*a* and 38*b*. It will be understood that the wheel plate 32 is of identical but opposite-hand construction with respect to the wheel plate 31.

A blade 10 is provided for each of the pair of crosswise aligned grooves 38. Each blade is mounted in place by being inserted within the central opening of the wheel defined by the inner annular surfaces 40 and 41 formed by respective wheel plates 31, 32. As noted in FIG. 6, each groove 38 opens into or communicates with the inner annular surface 41. Similarly, the grooves 38 open into the outer annular surfaces 42, 43 defined by respective wheel plates 31, 32.

Each blade 10 is retained in place by engagement of the retaining lug surfaces 24*a* and 25*a* with respective inner annular surfaces 32 and 31. Referring to FIG. 6, for example, it will be understood that the retaining lug formation 24*a* engages the inner annular surface 41 at the shaded area indicated as 45.

Hence, each blade is retained in place under the influence of centrifugal force with the retaining lug formations in abutting engagement with the inner annular surfaces. The side flanges 14 and 15 of each blade are received within the grooves 38 in closely spaced relationship with the walls 38*a* and 38*b*. The blades may be readily removed, for replacement purposes, through the central opening defined by the annular surfaces 40 and 41.

As noted in FIG. 5, the impeller of the centrifugal blasting wheel includes an annular flange 47 provided with slots 48 for receiving the inner ends of the blades 10. This engagement between the blades and the slots insures that the impeller rotates in timed relationship with the blades for proper feeding of the particulate material, all as more fully explained in the aforementioned Schulte et al., U.S. Pat. No. 4,333,278.

Reference is now made to FIGS. 7 and 8 showing another form of centrifugal blasting wheel. The parts of this wheel which correspond to the parts of the wheel already described are indicated by the prime form of numeral.

Each grove 38' communicates with a recess or pocket 50. This recess opens into the annular surface 41' and interrupts the same. Again, it will be understood that the wheel plates 31' and 32' are of identical but opposite-hand construction.

It is noted that the recess 50 extends circumferentially of the groove 38' beyond the opposed walls 38*a'* and 38*b'*. Thus, the recess 50 defines a pair of abutment surfaces 50*a* and 50*b*. As noted in FIG. 8, the recess 50 has a depth greater than the depth of the groove 38'; thus, the recess 50 may define another abutment surface 50*c*.

It will be understood that a blade 10 is mounted between each pair of crosswise aligned grooves 38' in the wheel 30'. The blades are held in place primarily by use of the retaining lug formations 24*b*, 24*c*, 25*b* and 25*c*. For example, it will be understood that the retaining lug formations 24*b* and 24*c* will be in abutting engagement with respective abutment surfaces 50*a* and 50*b*.

As just indicated, the blade 10 is designed such that it may be held in place in the wheel 30' only by using the retaining lug formations 24*b*, 24*c*, 25*b* and 25*c*. However, it may be desired to configure the surfaces 50*c* to aid in retaining the blades in place. This is achieved by forming the surface 50*c* with the same radius that defines the abutment surfaces 50*a* and 50*b*. Accordingly, when the blade 10 is mounted in the wheel 30', the retaining lug formations 24*a* and 25*a* will engage the abutment surfaces 50*c* at the same time as the other retaining lug formations on the blade engage the abutment surfaces 50*a* and 50*b*.

Thus, it will be seen that the present invention provides a blade which may be used in two different forms of centrifugal blasting wheels. It will be understood that changes may be made in details of construction, arrangement and operation without departing from the spirit of the invention, especially as defined in the following claims.

I claim:

1. For use in:

(a) a first centrifugal blasting wheel of the type including a pair of front and back wheel plates interconnected in spaced parallel relationship with each wheel plate having a central opening defined by an annular surface, wherein said plates are provided with respective crosswise aligned grooves in their inner faces extending radially in equally circumferentially spaced relationship from the inner annular surfaces of the plates to the outer annular surfaces thereof and opening into each of said annular surfaces, wherein each of said grooves defines a pair of parallel opposed walls; or (b) a second centrifugal blasting wheel of the type including a pair of front and back wheel plates interconnected in parallel spaced relationship with each wheel plate having a central opening defined by an annular surface, wherein said plates are provided with respective crosswise aligned grooves in their inner faces extending radially in equally circumferentially spaced relationship, wherein each of said grooves defines a pair of parallel opposed walls, said wheel plates also being provided with respective crosswise aligned recesses which open into said inner annular surfaces thereby interrupting the same, each pair of said radially extending grooves communicating with a respective pair of said recesses and with the outer annular surfaces of the wheel plates, each of said recesses having a depth greater than the depth of the associated groove, each of said recesses extending circumferentially of the wheel plate beyond the adjacent walls of the associated groove thereby defining a pair of abutment surfaces spaced from the inner annular surface of the wheel plate;

a blade for each pair of aligned grooves in either of said first or second wheel plates, said blade comprising a body generally in the form of a parallelepiped having an inner and an outer end and side flanges to define a blade which is I-shaped in transverse cross-section, a first retaining lug formation on said body adjacent one of the side flanges and being disposed at the inner end of the blade, said first retaining lug formation extending laterally of the adjacent blade flange and being arranged to engage the inner annular surface of the adjacent wheel plate when the blade is operatively positioned with the side flanges disposed between the walls of a pair of grooves in said first wheel, a second retaining lug formation on said body adjacent one of the side flanges and being disposed at the inner end of the blade in close proximity to said first retaining lug formation, said second retaining lug formation extending beyond the adjacent blade flange in a direction generally at a right angle to the direction said first retaining lug formation extends from the adjacent side flange, said second retaining lug formation being arranged to engage one of said abutment surfaces in the adjacent wheel plate when the blade is operatively positioned with the side flanges disposed between the walls of a pair of grooves in said second wheel.

2. The blade as claimed in claim 1 wherein said first and second retaining lug formations adjoin each other in a smooth and continuous manner.

3. The blade according to claim 2 wherein said first and second retaining lug formations are arcuate and, when installed in the first wheel, have a common radius which is the same as the radius of the central opening of the first wheel.

4. The blade as claimed in claim 2 wherein said body is symmetrical with respect to a radial plane containing the axis of rotation of the wheel, and wherein said body is also symmetrical with respect to a plane perpendicular to said first-mentioned plane and containing the longitudinal central axis of the blade.

5. The blade as claimed in claim 3 wherein said body is symmetrical with respect to a radial plane containing the axis of rotation of the wheel, and wherein said body is also symmetrical with respect to a plane perpendicular to said first-mentioned plane and containing the longitudinal central axis of the blade.

* * * * *